US009179761B2

(12) United States Patent
Rambelli

(10) Patent No.: US 9,179,761 B2
(45) Date of Patent: Nov. 10, 2015

(54) DEVICE FOR SHOULDERING SKIS AND SKI POLES

(71) Applicant: AMOCOMODO S.R.L. CON UNICO SOCIO, Rimini (IT)

(72) Inventor: Antonio Rambelli, Russi (IT)

(73) Assignee: AMOCOMODO S.R.L. CON UNICO SOCIO, Rimini (IT)

( * ) Notice: Subject to any disclaimer, the term of this patent is extended or adjusted under 35 U.S.C. 154(b) by 0 days.

(21) Appl. No.: 14/354,886

(22) PCT Filed: Oct. 29, 2012

(86) PCT No.: PCT/IB2012/055980
§ 371 (c)(1),
(2) Date: Apr. 28, 2014

(87) PCT Pub. No.: WO2013/061311
PCT Pub. Date: May 2, 2013

(65) Prior Publication Data

US 2014/0305984 A1 Oct. 16, 2014

(30) Foreign Application Priority Data

Oct. 28, 2011 (IT) ..... BO2011U0088 U

(51) Int. Cl.
*A45F 5/00* (2006.01)
*A45F 3/14* (2006.01)
*A63C 11/02* (2006.01)

(52) U.S. Cl.
CPC ... *A45F 5/00* (2013.01); *A45F 3/14* (2013.01); *A63C 11/025* (2013.01); *A45F 2003/142* (2013.01); *A45F 2200/05* (2013.01)

(58) Field of Classification Search
CPC ..... A45F 5/00; A45F 2005/002; A45F 5/004; A61C 11/02; A61C 11/021; A61C 11/025
See application file for complete search history.

(56) References Cited

U.S. PATENT DOCUMENTS 3,947,927 A 4/1976 Rosenthal
3,968,670 A * 7/1976 Quenot ..... 70/456 R (Continued)

FOREIGN PATENT DOCUMENTS

DE 7708028 U1 6/1977
DE 3426584 A1 1/1986

(Continued)

OTHER PUBLICATIONS

International Search Report of PCT/IB2012/055980 Dated Mar. 15, 2013 With Written Opinion of the International Searching Authority.

*Primary Examiner* — Brian D Nash
(74) *Attorney, Agent, or Firm* — Venable LLP; Robert Kinberg

(57) ABSTRACT

A device for the shoulder support of skis and poles has a box shaped body. A spool is rotatably mounted inside the box shaped body. A tape is at least partially wrapped around the spool. A preloaded spring acts on the spool and against the action of which the tape can be extracted and by the action of which the tape is recalled to be wound onto the spool. A first strap is externally connected to the box shaped body and is adapted to define a first ring to be tightened around at least one ski pole and to be fixed by way of a fixing system in a predefined position. A second strap is connected to the first strap and is adapted to define a ring of variable size to be tightened around at least one ski pole.

12 Claims, 4 Drawing Sheets

(56) References Cited

U.S. PATENT DOCUMENTS

| | | | | | |
|---|---|---|---|---|---|
| 4,414,969 | A | * | 11/1983 | Heyman | 128/878 |
| 4,658,999 | A | * | 4/1987 | Hilty | 224/609 |
| 4,862,563 | A | * | 9/1989 | Flynn | 24/442 |
| 5,026,088 | A | * | 6/1991 | Stuart | 280/637 |
| 5,294,029 | A | * | 3/1994 | Shimura et al. | 224/162 |
| D351,336 | S | * | 10/1994 | Dean et al. | D8/394 |
| 5,388,741 | A | * | 2/1995 | Hillinger | 224/679 |
| 5,513,785 | A | * | 5/1996 | Campagna, Jr. | 224/162 |
| 5,782,708 | A | * | 7/1998 | Kimball, Jr. | 473/408 |
| 5,833,188 | A | * | 11/1998 | Studdiford et al. | 248/229.17 |
| 5,897,039 | A | * | 4/1999 | Swenke | 224/162 |
| 6,257,469 | B1 | * | 7/2001 | Cohn | 224/162 |
| 6,502,727 | B1 | * | 1/2003 | Decoteau | 224/162 |
| 6,824,028 | B2 | * | 11/2004 | Mutai et al. | 224/271 |
| 8,220,676 | B1 | * | 7/2012 | Hicks | 224/162 |
| 8,806,723 | B2 | * | 8/2014 | Martinson et al. | 24/343 |
| 8,845,032 | B2 | * | 9/2014 | Bruce et al. | 297/483 |
| 2003/0010861 | A1 | * | 1/2003 | Tsan | 242/385.3 |
| 2005/0115999 | A1 | * | 6/2005 | Johnson | 224/269 |
| 2005/0173477 | A1 | * | 8/2005 | Scott | 224/148.6 |
| 2005/0258203 | A1 | * | 11/2005 | Weaver | 224/162 |
| 2007/0205235 | A1 | * | 9/2007 | Knight et al. | 224/223 |
| 2009/0209369 | A1 | * | 8/2009 | Smith et al. | 473/406 |
| 2009/0212082 | A1 | * | 8/2009 | Bautista et al. | 224/257 |
| 2010/0181352 | A1 | * | 7/2010 | Imafuku et al. | 224/162 |
| 2011/0174852 | A1 | * | 7/2011 | Young et al. | 224/268 |

FOREIGN PATENT DOCUMENTS

| | | | |
|---|---|---|---|
| FR | 2893512 | A1 | 5/2007 |
| GB | 2162742 | A | 2/1986 |
| GB | 2451696 | A | 2/2009 |

* cited by examiner

DEVICE FOR SHOULDERING SKIS AND SKI POLES

TECHNICAL FIELD

The present invention relates to a device for the shoulder transport of a pair of skis and poles.

BACKGROUND ART

As known several devices are known for the shoulder support of skis. A first type of such devices comprises a member defined by two plates that surround the central part of the skis and that are provided with a handle for the support of the same.

It is evident that the aforementioned ski carrier member has a high encumbrance and therefore said member cannot be carried by the user when the latter is skiing. A second type of these devices provides a spool housed in a member of the ski boot binding with which each ski is provided. Said device, however, involves a modification of the ski boot binding and therefore cannot be used for ski provided with an unmodified ski boot binding.

DISCLOSURE OF INVENTION

The purpose of the present invention is to provide a device for the shoulder transport of skis and poles that is free from the above drawbacks.

According to the present invention a device as claimed in claim 1 and, preferably, in any one of the following Claims depending directly or indirectly on claim 1 is provided.

BRIEF DESCRIPTION OF THE DRAWINGS

For a better understanding of the present invention a preferred embodiment is now described, purely by way of non-limiting example, with the aid of the figures of the accompanying drawings, wherein.

BEST MODE FOR CARRYING OUT THE INVENTION

Figure 1:
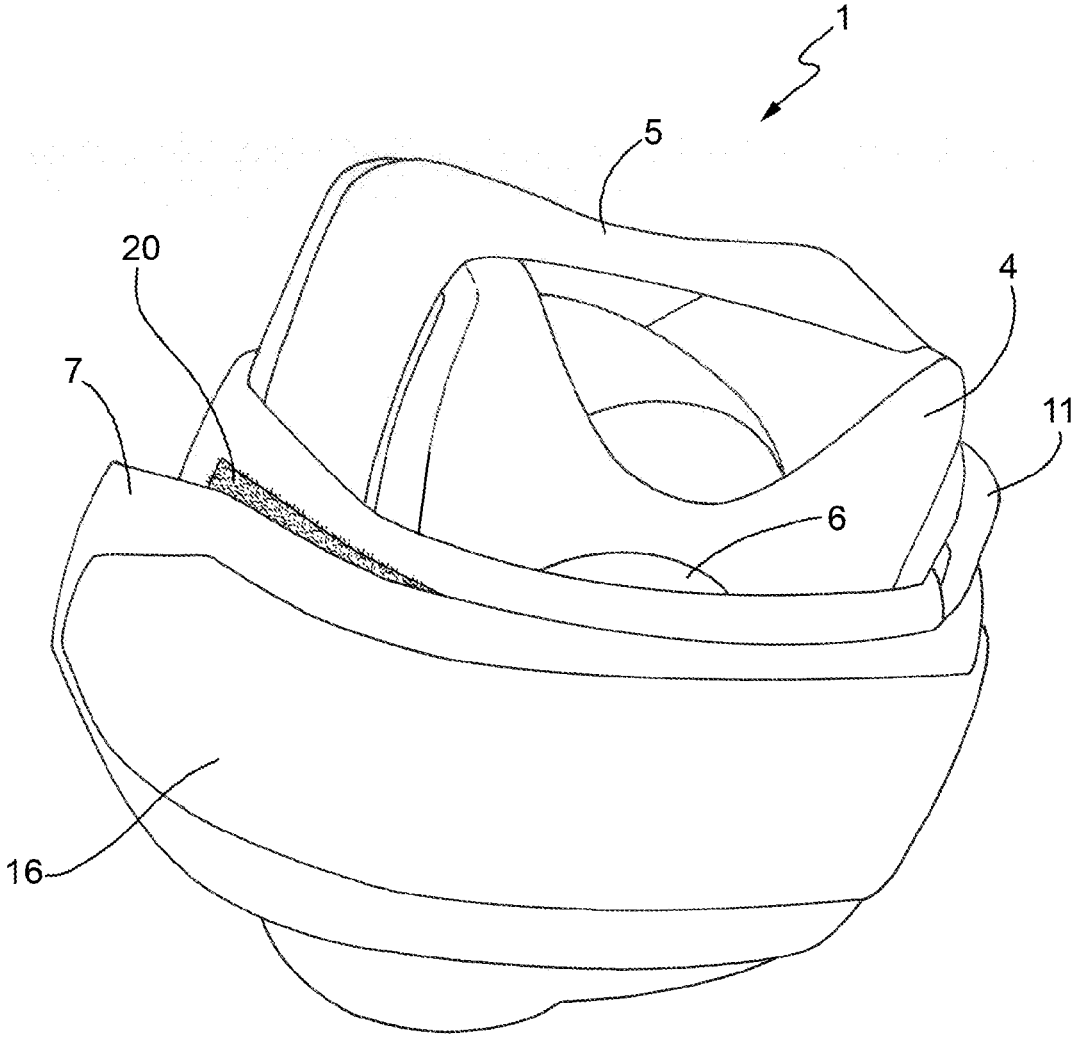
FIG. 1 is a perspective view of a device made according to the teachings of the present invention.
Figure 2:
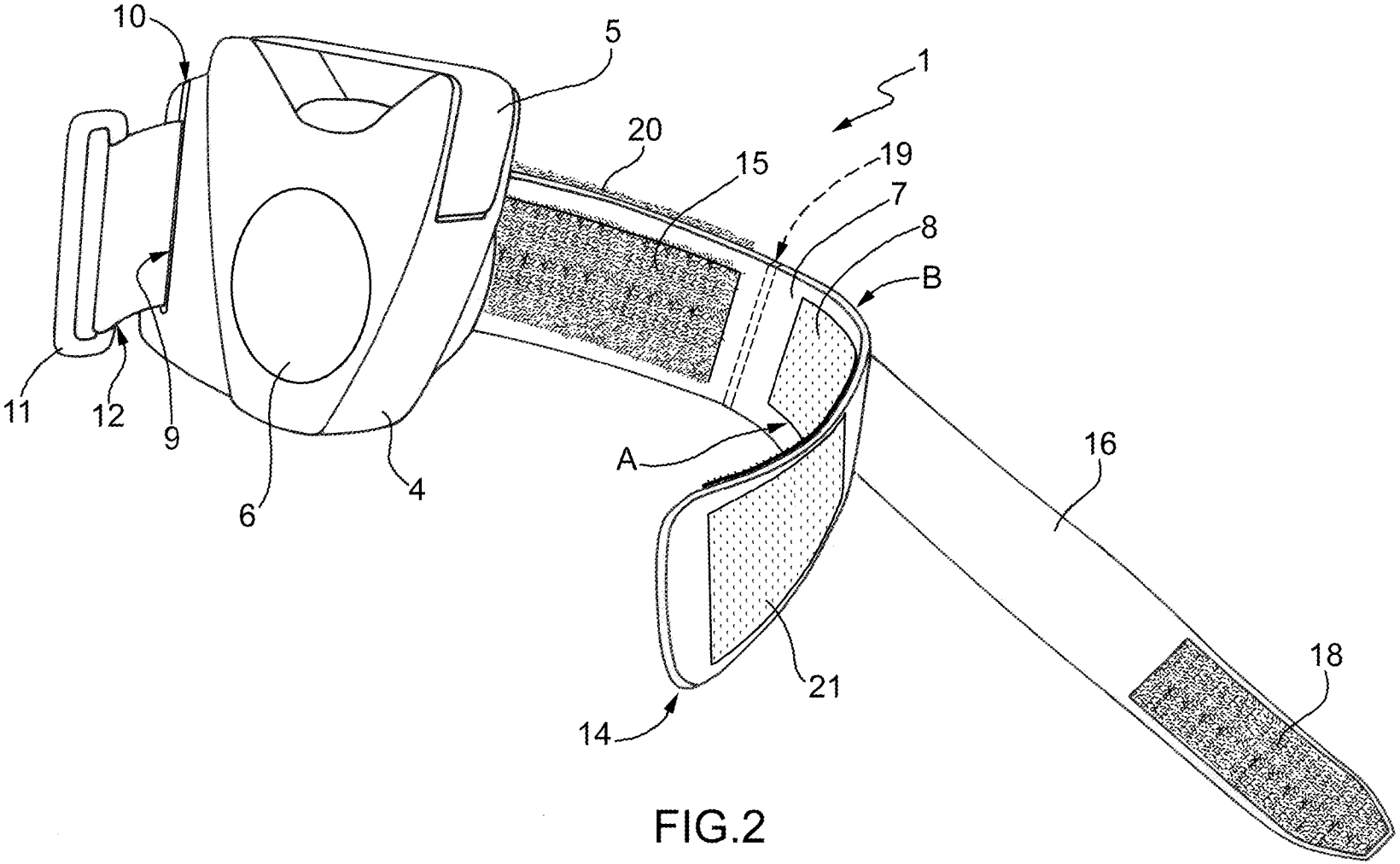
FIG. 2 shows the device according to the present invention in an extended configuration.
Figure 3:
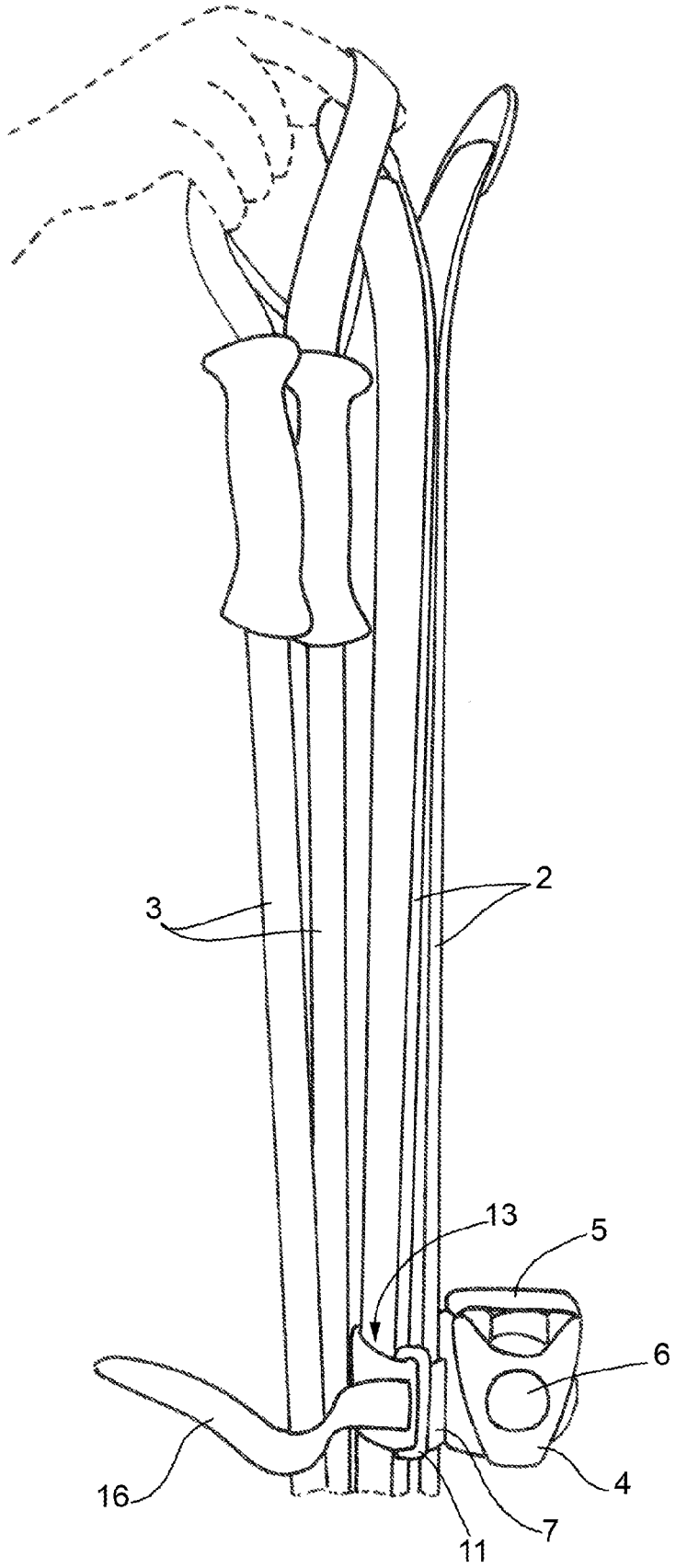
FIGS. 3 and 4 illustrate the device of FIG. 1 applied to the skis 2 and, respectively, to the ski poles 3.
Figure 4:
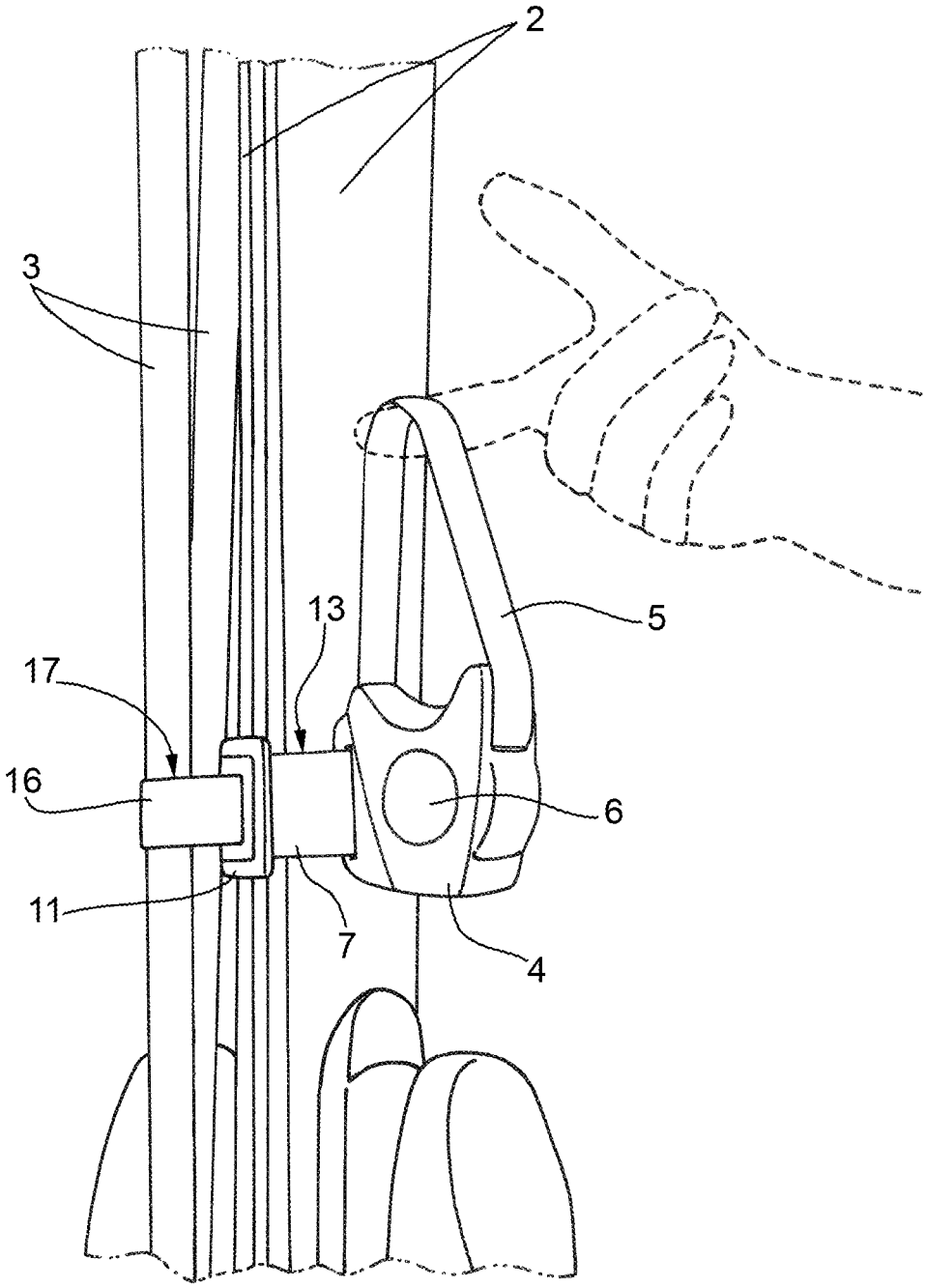

With reference to FIGS. 1 and 2 number 1 denotes as a whole a device for the shoulder support of skis 2 and ski poles 3 comprising a box shaped body 4, a spool (of known type and not illustrated), which is rotatably mounted inside the box shaped body 4, a tape 5, which is at least partially wound around the spool, and a pre-loaded spring (of a known type and not illustrated), which acts on the spool and against the action of which the tape 5 can be extracted and by the action of which the tape 5 is recalled to be wound onto the spool. In particular, the box shaped body 4 comprises a hooking element (not illustrated and of known type), which acts on the spool and is adapted to lock it in a predefined position, and a release button 6 to free the spool and cause the automatic winding of the tape 5.

The device 1 also comprises a strap 7 binding the ski 2, which is externally connected to the box shaped body 4 and is adapted to clasp the pair of skis 2 and to fix them to the box shaped body 4 itself. It is noted that the strap 7 binding the ski 2 is adapted to be ring tightened around at least one ski 2. Preferably, the strap 7 is adapted to be ring tightened around a pair of ski 2. In particular, the box shaped body 4 has a slot 9, in which a portion of the strap 7 binding the ski 2 is inserted. The slot 9 has an upper opening 10 through which is possible to insert sideways the strap 7 binding the ski 2 inside the slot 9 itself.

Preferably, the strap 7 comprises a circular element 11 which protrudes at one end 12 of the strap 7 itself and is adapted to be traversed by at least a portion of the strap 7 itself for the formation of a ring 13 of variable sizes. In particular, the strap 7 has one free end 14 adapted to pass through the circular element 11 for the formation of the ring 13. The size of the ring 13 is variable as a function of the position of the end 14 with respect to the circular element 11.

As illustrated in FIG. 2, the strap 7 has an "inner" surface A and an "outer" surface B and comprises a fastening system realized by way of Velcro. In particular, the strap 7 comprises a portion 15 of looped material and a portion 8 of hooked material, which are adapted to adhere to one another and protrude from the "inner" surface A. In particular, the portion 8 extends from the end 14 up to an intermediate area 19 of the strap 7; while, the portion 15 extends from the intermediate area 19 to the connection point with the box shaped body 4.

Similarly, the strap 7 comprises a portion 20 of looped material and a portion 21 of hooked material, which protrude from the "outer" surface B. In particular, the portion 21 extends from the end 14 to the intermediate area 19; while, the portion 20 extends from the area 19 to the box shaped body 4.

As illustrated in the figures, the device 1 comprises, furthermore, a strap 16 binding the ski poles 3 which is connected to the strap 7 binding the skis 2 itself and is adapted to clasp at least one ski pole 3 to the skis 2. In particular, the strap 16 is connected to the strap 7 in correspondence to the intermediate area 19 and protrudes from the "outer" surface B. It is noted that the strap 16 is adapted to define a ring 17 of variable size to tighten at least one ski pole 3.

In particular, the strap 16 binding the ski poles 3 comprises at least a closing portion 18 adapted to adhere to the strap 7 binding the skis 2. For example, the portion 18 is made of looped material to adhere to the portion 21 of the strap 7.

It is noted that in the present disclosure the terms looped material and hooked material were used referring to materials which penetrate and adhere to each other. As illustrated in the figures, the looped material is a furry material generally known as "loop", whereas, the hooked material is a material that has hooks adapted to hook with the furry or "looped" material.

According to an alternative not shown, the portion 15, the portion 18 and the portion 20 are made of hooked material, i.e. having hooks; while, the portion 8 and the portion 21 are made of looped material i.e. furry .

According to an alternative not shown, the strap 16 binding the ski poles 3 is made of elastic material and is fixed in at least two points to the strap 7 binding the skis 2, so as to delimit a portion of strap 16 binding the ski poles 3 not adherent to the strap 7 binding ski 2 itself and of variable sizes, depending on the level of extension of the elastic material. Preferably, the strap 7 binding the ski 2 is adapted to form a pocket of extended dimensions and such as to house one or more ski poles 3.

In what follows is described the use of the device 1 according to the present invention.

A pair of skis 2 are set adjacent to one another and the box shaped body 4 is positioned against at least one ski 2, so that the strap 7 binding the ski 2 is arranged in the vicinity of the skis 2 themselves.

Then, the strap 7 binding the ski 2 is wound around the skis 2 and is passed through the circular element 11, so as to form the ring 13. Subsequently, the strap 7 binding the ski 2 itself is tightened so as to tighten one ski to the other ski 2 and fastening them to the box shaped body 4. As the ring 13 is formed, the portion 8 of the hooked material adheres to the portion 15 of looped material. The fastening level of the skis 2 depends basically on the position of the end 14 relative to the circular element 11.

Finally, the strap 16 binding the poles 3 is tightened around at least a pole 3 according to the procedures described above, the portion 18 being able to adhere to the portion 21 of the strap 7 binding the ski 2. In the case wherein the strap 16 binding the ski poles 3 is made of elastic material, the width of the ring 17 depends on the degree of extension of the strap 16 binding the ski poles 3 itself.

Once the skis 2 and the ski poles 3 are fastened according to the procedures described above, the skier pulls the tape 5 up to the attainment of a shoulder strap (obtained with the tape 5 itself) at a sufficient length to be positioned on a shoulder.

When the skier has finished the transport of the skis 2, the strap 16 and the strap 7 are loosened so as to free the skis 2 and the ski poles 3. Therefore, the strap 16 is made to adhere to the strap 7 leading to contact the portion 18 with the portion 21 so as to achieve a single band, which is wrapped around and secured to the box shaped body 4 by adhering the portion 8 with the portion 21 of the strap 7. Therefore, the device 1 can be stored in a pocket when not in use.

From that described above the advantages achieved with the implementation of the present invention are evident and numerous.

In particular a device which allows to shoulder carry a pair of skis 2 and respective ski poles 3 is provided. The system is simple and easy to use and allows an adjustment of the length of the tape to better adapt to the user.

The invention claimed is:

1. A device for the shoulder support of skis and poles comprising: a box shaped body: a spool rotatably mounted inside the box shaped body: a tape at least partially wound around the spool; a preloaded spring acting on the spool and against the action of which the tape is extractable and by the action of which the tape is recalled to be wound onto the spool; a first strap connected externally to the box shaped body and adapted to define a first ring of variable size for tightening around at least one ski and for fixing by way of a fixing system in a desired position, the first strap having a first and a second free end and an intermediate area; and a second strap connected to the first strap and adapted to define a second ring of variable size for tightening around at least one ski pole; wherein the second strap has a portion of looped material facing the first strap.

2. The device according to claim 1, wherein the first strap has a first side surface and a second side surface of greater dimensions; wherein the fixing system of the first strap comprises velcro.

3. The device according to claim 2, wherein the first strap comprises a first portion of looped material and a first portion of hooked material, which are adapted to adhere to one another and protrude from the first surface.

4. The device according to claim 3, wherein the first portion of hooked material extends from the second free end to the intermediate area: and wherein, the first portion of looped material extends between the intermediate area and the box shaped body.

5. The device according to claim 2, wherein the first strap comprises a second portion of looped material and a second portion of hooked material, which protrude from the second side surface.

6. The device according to claim 5, wherein the second portion of hooked material extends from the second free end to the intermediate area, and wherein, the second portion of looped material extends between the intermediate area and the box shaped body.

7. The device according to claim 2, wherein the second strap protrudes from the second side surface of the first strap substantially in correspondence to the intermediate area.

8. The device according to claim 1, wherein the second strap is made, at least in part, of an elastic material.

9. The device according to claim 1, wherein the first strap comprises a circular element that protrudes at the first end of the first strap itself and is adapted to be crossed by at least a portion of said first strap for the formation of a ring of variable sizes.

10. The device according to claim 1, wherein the box shaped body comprises a hooking element, which acts on the spool and is adapted to lock it in a predefined position; the device comprising a release button to free the spool and cause the automatic winding of the tape.

11. The device according to claim 1, wherein the box shaped body has a slot wherein a portion of the first strap is inserted.

12. A device for the shoulder support of skis and poles comprising: a box shaped body: a spool rotatably mounted inside the box shaped body: a tape at least partially wound around the spool; a preloaded spring acting on the spool and against the action of which the tape is extractable and by the action of which the tape is recalled to be wound onto the spool; a first strap connected externally to the box shaped body and adapted to define a first ring of variable size for tightening around at one ski and for fixing by way of a fixing system in a desired position, the first strap having a first and a second free end and an intermediate area; and a second strap connected to the first strap and adapted to define a second ring of variable size for tightening around at least one ski pole, wherein the second strap is made, at least in part, of an elastic material and is fixed at two points to the first strap to form a slot.

* * * * *